US006297569B1

(12) United States Patent
Bartels et al.

(10) Patent No.: US 6,297,569 B1
(45) **Date of Patent: *Oct. 2, 2001**

(54) POWER SWITCHING SYSTEM

(75) Inventors: James I. Bartels, Hudson, WI (US); Robert D. Juntunen, Minnetonka, MN (US); Paul B. Patton, Golden Valley, MN (US); Richard M. Solosky, Minnetonka, MN (US)

(73) Assignee: Honeywell International Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/223,851

(22) Filed: Dec. 31, 1998

(51) Int. Cl.[7] ..... H01H 3/26
(52) U.S. Cl. ..... 307/140; 307/125; 307/113
(58) Field of Search ..... 307/139, 143, 307/140, 115, 113, 125; 361/191

(56) References Cited

U.S. PATENT DOCUMENTS 4,298,334 * 11/1981 Clark et al. ..... 431/24
4,850,852 * 7/1989 Ballard ..... 431/6
5,041,775 * 8/1991 Erdman ..... 318/812
5,076,780 * 12/1991 Erdman ..... 431/24
5,277,575 * 1/1994 Newberry ..... 431/24

* cited by examiner

*Primary Examiner*—Stephen W. Jackson
*Assistant Examiner*—Sharon Polk

(57) ABSTRACT

A power controller has upstream and downstream switches in series connection to provide redundant switching for power supplied from a power source to a load. A switch operating system closes the switch closer to the load first (downstream) and then the switch closer to the source (upstream). The operating system conditions closing the downstream switch on absence of power voltage on an upstream power terminal of the downstream switch. A preferred embodiment of the operating system performs a number of real time status checks during the connection process to assure that power voltage is properly absent and present at switch terminals during the stages of the connection process. This operating system guards against supplying power to the load if either the upstream or downstream switch's pair of contacts are welded at the time the connection process starts.

21 Claims, 3 Drawing Sheets

POWER SWITCHING SYSTEM

BACKGROUND OF THE INVENTION

Electrically powered systems rely on a variety of switches for controlling their operation. These switches may be solid state devices such as SCRs or triacs, or may be electromechanical relays. (The term "switch" will be used hereafter to refer to any device having a pair of power terminals whose conductive state is controlled by an electrical signal on a control terminal of the device.) In either case it is important for safe operation of some systems that electrical power applied to them can be reliably controlled. In particular, many systems require near absolute certainty that power can be removed from them when desired. Combustion systems having fuel valves for controlling flow of pressurized fuel are one classic example of this situation.

Where solid state devices are involved, their failure mode is typically an open circuit which of course removes power from the system. A relay on the other hand, is notorious for failing with its switch contacts closed, so that removing power from the actuator coil does not remove power from the powered system. This condition of the contacts is referred to as welding. It is even possible that solid state switches can fail in a conducting mode, the solid state equivalent of relay contact welding. Because of their low switch resistance and the preferences of preexisting safety codes, relays are still usually used to switch power to the fuel valves in burner systems, so safe operation requires that relay contact welding not result in continued power flow to the controlled component of the system.

One expedient for increasing the reliability of disconnecting power from load for such switching systems is to use redundant switches, with two pairs of switch contacts in series. Thus if one pair of contacts weld, the other pair continues to safely provide switching for the powered system. One problem that arises with this arrangement however, is that once one contact pair welds, redundancy has been lost but the system continues to operate normally. The system is thus at risk of failure through welding of both contact pairs. Depending on how the switch control operates and the individual switch characteristics, it is possible that both switches will weld in near succession, say if both contact pairs have experienced approximately the same number of load switching operations. For systems where switch failure by welding creates an unsafe condition, the possibility of this type of failure should be avoided.

BRIEF DESCRIPTION OF THE INVENTION

We disclose below a power connection system which substantially reduces the likelihood of this contact weld failure mode of redundant switch pairs. This system relies on the realization that the activities which usually cause a contact pair to fail are closing and opening of the contacts. That is, simply carrying current does not usually cause contact pair deterioration or welding. Accordingly, if in a redundant switching system, one switch is dedicated to handling power switching, then that switch is one which is far and away the most likely to fail.

Such a power connection system is intended to supply power from a source to a load during a demand signal interval in which a demand signal exists. The connection system has a first electrically controlled switch having first and second power terminals, and a first control terminal for receiving a first connect signal. The first switch establishes electrical contact between the first and second power terminals responsive to the first connect signal. A second electrically controlled switch also has first and second power terminals, and a second control terminal for receiving a second connect signal. The second switch is responsive to the second connect to establish electrical contact between the switch's first and second power terminals. The first switch's first power terminal is for connection to the power source. The first switch's second power terminal is connected to the second switch's first power terminal. The second switch's second power terminal is for connection to the load. It is convenient to consider the first switch as the upstream switch, as it is to be connected to the power source. The second switch can be designated the downstream switch as it is connected directly to the load.

The power connection system includes a switch operating system having a first voltage sensor having a sensor terminal connected to the first switch's second power terminal, and providing at a signal terminal a power signal having a first value responsive to power voltage at the sensor terminal and having a second value otherwise. There is a switch status detector receiving the demand signal and the power signal which provides a status signal having a first value except when the demand signal and the second value of the power signal simultaneously exist, which causes this detector to provide a status signal having a second value.

A switch controller receives the status signal and responsive to the second value thereof, provides the connect signal to the second switch's control terminal and after a preselected interval, provides the connect signal to the first switch's control terminal. Thus according to this description, the first (upstream) switch always closes after the second (downstream) switch closes. Experience teaches that the switch which actually makes and breaks the connection is much more likely to fail, and such a failure is often a welded mode failure. Accordingly, the first switch is much more likely than the second switch to fail in a welded mode. With this arrangement, failure of the switch more likely to fail can be detected without having the other switch closed and therefore liable itself to welding, a safer arrangement. That is, if the first switch performs the power switching function, and experiences a welded mode failure, this is detectable regardless of the status of the second switch.

A complementary operation is used to open the switches. To open the switches, a first disconnect element in the switch controller ends the first connect signal responsive to the end of the demand signal. A second delay element receives the first connect signal and provides a delayed first connect signal. A second disconnect element ends the second connect signal responsive to the end of the delayed first connect signal.

There are a number of switch status configurations which indicate switch or other failures, and a preferred embodiment of the invention detects many of these and provides an error signal or locks out the switch operating system.

DESCRIPTION OF THE PREFERRED EMBODIMENTS

Introduction

Figure 1:
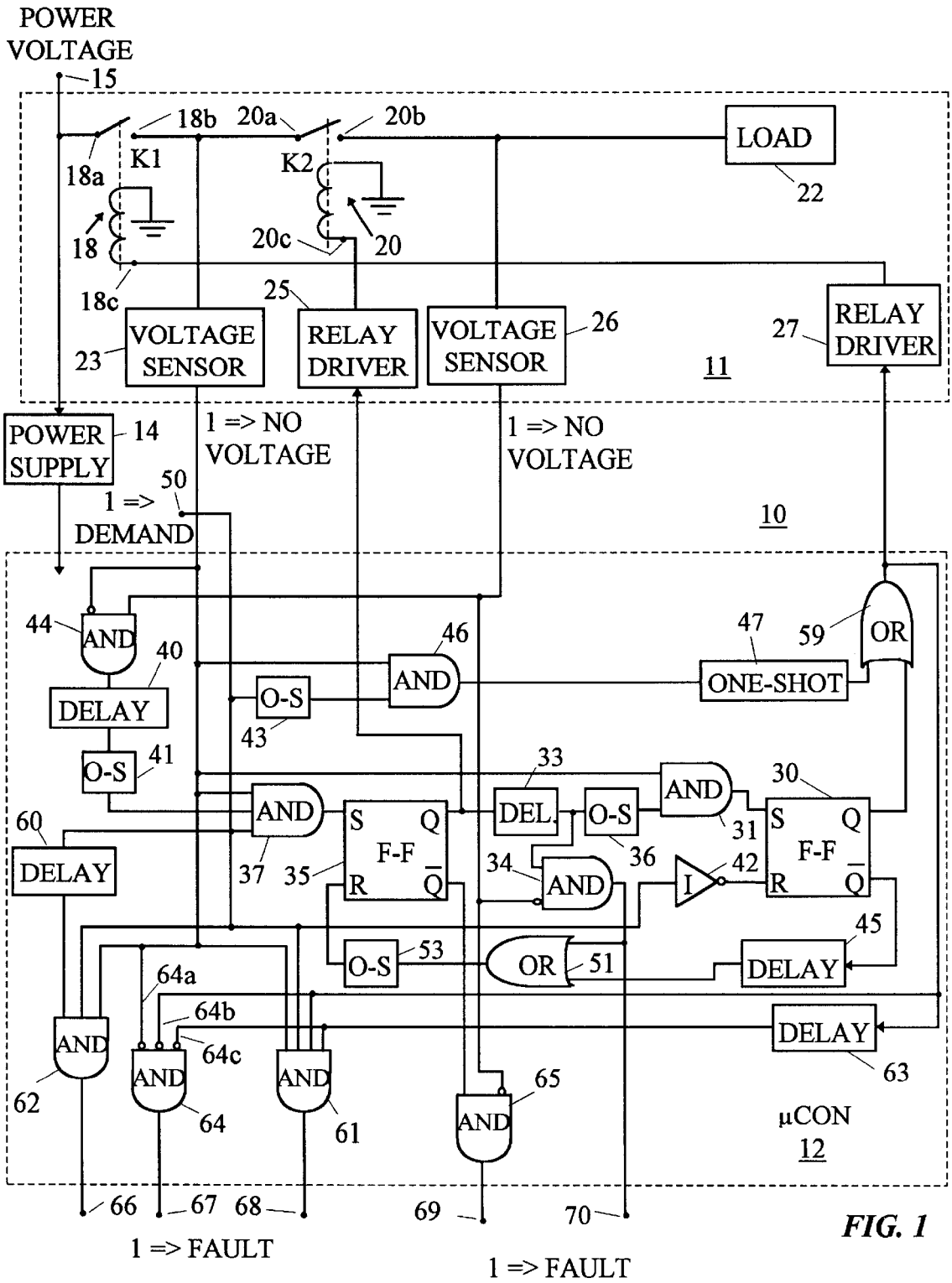
FIG. 1 is a block diagram of a power connection system which employs the invention.

The combined circuit block and logic diagram of FIG. 1 shows a power connection system 10 for connecting a power source represented by a power source terminal 15 to a load 22. In the specific application for which this invention was made, the load is a combustion control system, but in fact, load 22 may be any kind of load for which maximum assurance is necessary that it is properly powered and depowered. Power connection system 10 comprises a switching system 11 and a control system comprising a microcontroller 12. A power supply circuit 14 provides suitable DC power tour microcontroller 12.

The logic diagram comprising microcontroller 12 in FIG. 1 represents the actual logic elements which a conventional microcontroller becomes while executing the software or firmware implementing this invention. That is, microcontroller 12 actually becomes for brief periods of time, the functional equivalent of each of these various logic elements. Internal signals produced by microcontroller 12 while simulating these elements exist for brief periods of time. These signals are stored as data bits and can be used at a later time as inputs to the logic elements which the microcontroller 12 later becomes.

Actual power switching is under the control of the serially connected switching contacts of K1 and K2 relays 18 and 20. The state of these contacts is controlled through output ports or channels of microcontroller 12, by the microcontroller 12 while executing the firmware or software which implements the invention. There are a number of discrete functional steps which the microcontroller 12 and its firmware perform in connection with the individual hardware elements when enabling the connection between terminal 15 and load 22. Similarly, there are a further number of steps which the microcontroller 12 performs while disconnecting load 22 from terminal 15. Many of these functional steps are in fact tests to determine that the K1 and K2 relays 18 and 20 are operating correctly. These steps in the aggregate are quite complex, but the use of a microcontroller 12 to sequence them can be done very cheaply and reliably. Performing these test steps will in most cases here, require coincident double or triple errors for load 22 to be or to remain improperly connected to terminal 15. Given the fact that even a single error is very unlikely, and that any single error will in almost all cases lock out the system before a second error can occur, improper connection between terminal 15 and load 22 becomes an exceedingly rare occurrence.

As mentioned above, the use of relays is merely exemplary, and in fact these relays as well as various solid state devices fall generally within the term "switch" where the switch state is under the control of a connect signal. In point of fact, relays are often preferred to solid state switches because relays have very little inherent switch resistance and because of this, use less power overall than do solid state switches. K1 relay 18 has a first power terminal 18*a* for connection to a power source terminal 15, and a second power terminal 18*b* which is connected and disconnected to terminal 18*a* by a switch comprising a movable contact which makes contact with a fixed contact to connect terminals 18*a* and 18*b*. This switch is under the control of an electrical connect signal at control terminal 18*c*. Similarly for K2 relay 20, power terminals 20*a* and 20*b* are electrically connected during the presence of a connect signal at control terminal 20*c* by contact between a controllable contact pair. Power terminal 18*b* is connected to power terminal 20*a*. Power terminal 20*b* is for connection to a load 22. In the sense that power is provided at terminal 15, K1 relay 18 can be considered to be an upstream switch, and K2 relay 20 can be considered to be a downstream switch for connection to load 22. It is common to use relay drivers 25 and 27, which may be nothing more than transistors, to provide interfacing between logic level connect signals and the relays' coils. The relay drivers 25 and 27 provide current which close their respective relay's switch responsive to a logical 1 connect signal at the corresponding driver's input terminal.

Status (connected or not connected) of the K1 or K2 relay's power terminals 18*a* and 18*b* or 20*a* and 20*b* is not easy to directly detect. But if power voltage is known to be present on an upstream power terminal 18*a* or 20*a*, then status of the associated switch can be inferred by sensing voltage at the corresponding downstream terminal 18*b* or 20*b*. Accordingly, voltage sensors 23 and 26 have sensor terminals connected to downstream power terminals 18*b* and 20*b* respectively. Presence of power voltage at terminals 15 and 18*a* is presumed, for if no power at these terminals is present, then the entire circuit 10 can be presumed to be unpowered as well.

It is common for terminals 15 and 50 to be tied together, so that operating power serves as the demand signal to terminal 50. This situation arises commonly where demand is sensed by an outside element such as a thermostat which switches power to terminal 15. In this case, power supply 14 and microcontroller 12 are designed to operate properly during the connect and disconnect sequences while power at terminal 15 is first applied and after it is removed. A suitable power supply 14 will have adequate storage in its filter capacitors to allow for a few seconds of microcontroller 12 operation after power is removed to effect proper disconnection. During startup, microcontroller 12 will delay operation until a suitable power voltage is available from power supply 14.

Voltage sensors 23 and 26 each provide a logical 1 value in a power signal when there is no power voltage at the respective sensor terminal and a logical 0 value when power voltage is sensed at the sensor terminal of the respective voltage sensor 23 or 26. Where power terminal 15 provides AC power, there are issues of switch bounce and waveform peaks and zero-crossing which voltage sensors 23 and 26 must address, and for which there are solutions in the art. Suffice it to say that it may take as long as 100 ms. after a connect signal is applied to a relay driver until a voltage at an upstream terminal 18*a* or 20*a* can propagate to a downstream terminal 18*b* or 20*b* and be detected by the respective voltage sensor 23 or 26. Accordingly, delay elements are provided as required to delay operations dependent on relay contact closure.

In most cases now, it is cheaper and more efficient to provide the functions of even a simple logic circuit with a microprocessor or microcontroller along with the necessary firmware or software, rather than to implement the circuit either in discrete components or in an ASIC (application specific integrated circuit). For this reason we choose to operate this switching system 11 under the control of microcontroller 12 and the software or firmware which it executes. However, we feel that a description in the form of the logic diagram of a circuit having the required functionality provides the best explanation for practicing the invention even though the discrete logic diagram form would normally not be a best mode of practicing the invention. Thus as previously discussed, microcontroller 12 is shown within dotted boundary lines as comprising a number of conventional logic elements which in time sequence it actually becomes.

Conceptually, there is absolutely no difference between a controller comprising dedicated or discrete logic elements on the one hand, and a microcontroller with appropriate firmware which it executes to implement the logic functions shown. Thus, with the understanding that the microcontroller 12 becomes each of the logic elements shown, FIG. 1 is in fact a preferred embodiment of the invention. Individual logic signals are represented by 0 or 1 values of bits (themselves briefly represented as signals within the microcontroller) stored in the microcontroller RAM and manipulated by the microcontroller.

Hardware Implementation

Figure 2A:
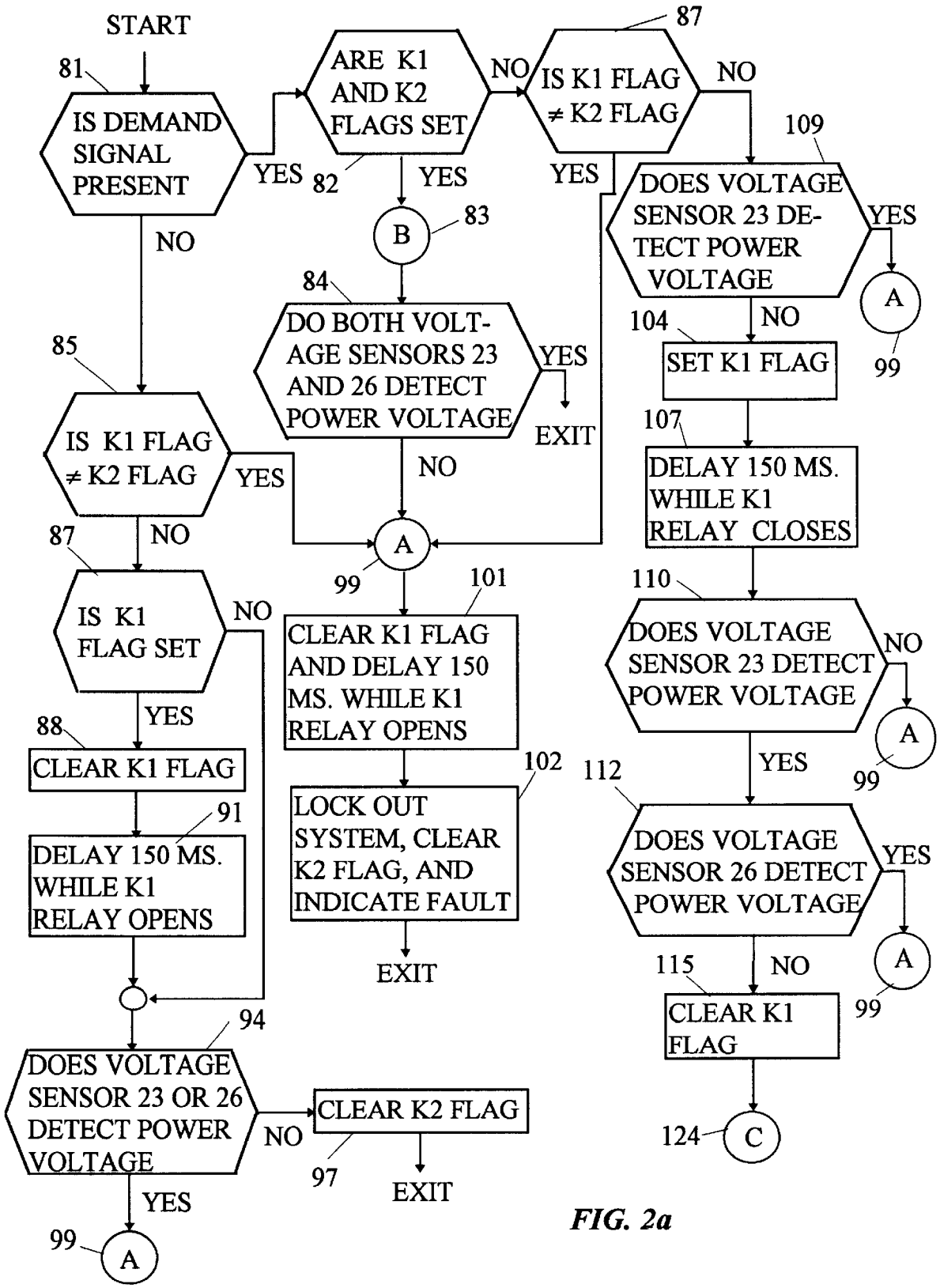
FIGS. 2*a* and 2*b* together form a flow chart of the firmware or software controlling operations of a microcontroller such as that forming a part of FIG. 1, to provide control to implement the invention.
Figure 2B:
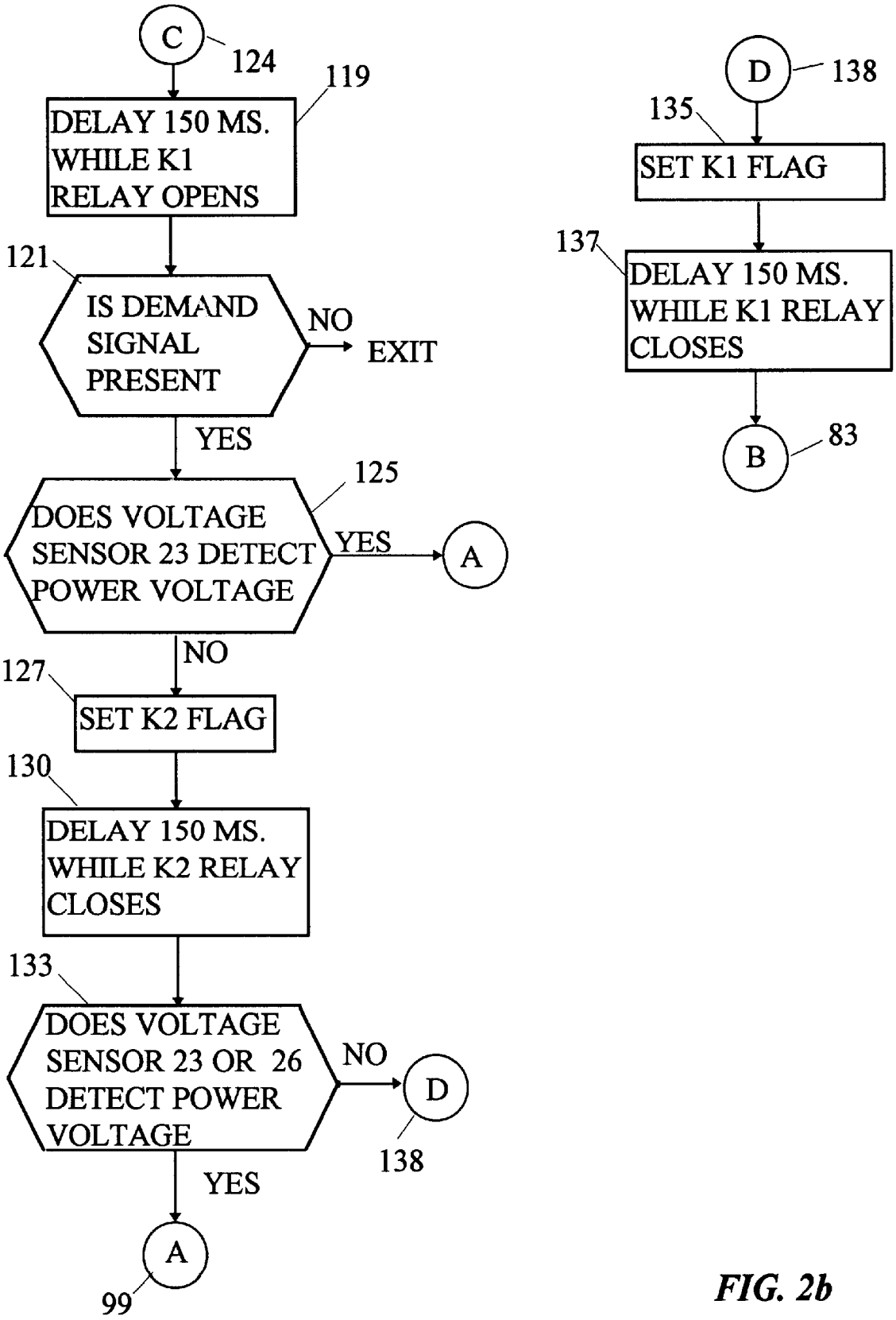

The logic block portion of the FIG. 1 diagram depicts the functional elements of a preferred embodiment for this invention and the functional relationships among them. A person with skill in the art can easily learn from FIG. 1 and the description here how to practice the invention. We expect that such a person will be familiar with Boolean algebra and understand how different voltage levels can be used to represent the Boolean 0 and 1 logic levels. FIGS. 2*a* and 2*b* disclose a preferred embodiment of the invention in terms of a firmware flow chart from which a person of reasonable skill in the art can easily develop the firmware to recreate a preferred microcontroller embodiment.

In FIG. 1, the K1 and K2 relays 18 and 20 each have individual contact pairs or switches which control the connection status between the power terminals 18*a*, 18*b* and 20*a*, 20*b*. Power terminals 18*a*, 18*b* and 20*a*, 20*b* thus control current flow from the power source terminal 15, to load 22. Current flow between terminal 15 and load 22 is to occur whenever a logical 1 demand signal at demand terminal 50 is present. The time during which a logical 1 signal is present at terminal 50 is called a demand interval. A logical 0 signal is present at terminal 50 other than during demand intervals. There are issues of initialization for this logic diagram which those familiar with logic design can easily address. An external source may provide the demand signal to terminal 50. The microcontroller 12 itself may have other firmware not a part of this invention which seis a flip-flop or other data storage element to represent a demand signal, perhaps based on physical status of a controlled system. And in some cases the demand signal is created by applying operating power (as opposed to power at terminal 15) to system 10. In this case, microcontroller 12 is designed to begin operation for processing the demand signal only after adequate voltage for proper operation is present. The microcontroller 12 must include hardware which delays instruction processing until adequate operating voltage is available from power supply 14. The power supply 14 must also store sufficient power to properly complete the operating sequence for disconnecting load 22 from terminal 15 when power is removed from the microcontroller 12. These are all well known issues in applying microprocessors to these types of applications.

A demand signal at terminal 50 starts with a transition from the logical 0 indicating that load 22 is disconnected from power source terminal 15, to the logical 1 designating that load 22 is to be connected to terminal 15. When load 22 is to be disconnected from terminal 15 at the end of the demand signal, there is a transition at terminal 50 from a logical 1 to a logical 0.

As mentioned a number of times previously, there are a number of tests which are performed by the logic circuit diagramed within microcontroller 12 in the course of connecting terminal 15 to load 22. These tests are to assure that switch system 11 is fully and safely operational. The first of these tests is to determine whether there may be a stray voltage present at the output terminal of K1 relay 18, perhaps as a result of miswiring. A one-shot element 43 receives the demand signal at its input terminal and provides a short logical 1 pulse in response to the input terminal of an AND gate 46. AND gate 46 receives the voltage sensor 23 output signal at a second input terminal. If there is voltage at terminal 18*b*, there will be a logical 0 at the second input terminal of AND gate 46, and therefore AND gate 46 output will remain a logical 0, and not change to a logical 1 value during the logical 1 output from one-shot 43. This prevents operation of the system from proceeding further.

The system of FIG. 1 then proceeds to test whether the K2 relay 20 switch is already closed and whether the K1 relay 18 can close its switch. If the K2 switch is closed at the start of the demand a fault condition exists. There is then no redundancy in the power switching circuit, and system 10 can fail catastrophically if the K1 relay 18 contact pair welds. This would mean that load 22 could not be disconnected from terminal 15.

To perform this next test, a one-shot 47 receives the logical 1 signal from AND gate 46 upon the transition from logical 0 to logical 1 of the demand signal which denotes the start of the demand interval. One-shot 47 is a standard logic element which responds to a logical 0 to logical 1 level change with a logical 1 output pulse to one input terminal of an OR gate 59. The duration of this logical 1 pulse (the time constant of one-shot 47) must be longer than the time K1 relay 18 takes to close, typically 50 to 150 ms. Other one-shots in the circuit of FIG. 1 have substantially shorter pulse times because they function only to change the state of a flip-flop.

The logical 1 pulse from one-shot 47 appears essentially unchanged at the output terminal of OR gate 59. The output of OR gate 59 comprises a connect signal applied to relay driver 27, causing relay driver 27 to apply current to K1 relay control terminal 18*c* and the K1 relay 18 switch to close, connecting power terminals 18*a* and 18*b*. 50–100 ms. after the start of the connect signal to terminal 18*c*, the voltage at terminal 15 will normally appear at power terminal 18*b* where it is sensed by a voltage sensor 23. Voltage sensor 23 provides a power signal having a logical 1 value while detecting absence of power voltage at terminal 18*b* and having a logical 0 value when voltage is detected. At this stage of the connect process there should be power voltage at terminal 18*b* and there should NOT be power voltage at terminal 20*b* because the K2 relay driver 25 has not received a connect signal. If there is power voltage at terminal 20*b* at this stage, then this implies that the K2 relay 20 switch was closed at the start of the demand interval, which is a fault condition and the connect process must be aborted.

The normal condition of voltage at terminal 18*b* and no voltage at terminal 20*b* is detected by AND gate 44. The power signal from voltage sensor 23 is applied to an inverting input of AND gate 44 and the power signal from voltage sensor 26 is applied to a non-inverting input of AND gate 44. AND gate 44, one-shot 47, voltage sensor 26, and K1 relay 18 together function as a status detector for the K2 relay 20 switch. Skilled logic designers can easily devise other circuit element arrangements equally suitable for serving as the status detector for the K2 relay 20 switch. If system 11 is operating normally, the output of voltage sensor 26 remains unchanged at logical 1, but the power signal from voltage sensor 23 changes from logical 1 to logical 0 during the pulse from one-shot 47, causing the output of AND gate 44 to change from logical 0 to logical 1. The change from logical 0 to logical 1 in the output signal from AND gate 44 is applied to the input terminal of a delay element 40, and appears at its output terminal after the delay time of element 40 has elapsed. At the end of the delay time for delay element 40, the logical 0 to logical 1 transition from AND gate 44 is applied to a second one-shot 41. In response to this signal change, one-shot 41 issues a logical 1 pulse having a duration which is not substantially longer than that which will eventually be required to set flip-flop 35, typically a few microseconds. The delay element 40 delay time should be selected to be at least the maximum time which the K1 relay 18 switch requires to open after the pulse provided by one-shot 47 ends, say 100–150 ms. worst case. The delay time of delay element 40 and the duration of the one-shot 47 pulse must be chosen so that the logical 1 pulse from one-shot 41 occurs after the K1 relay 18 switch has opened in response to the end of the pulse from one-shot 47.

The pulse from one-shot 41, the demand signal at terminal 50, and the power signal from voltage sensor 23 are all applied to the inputs of an AND gate 37. Thus AND gate 37, voltage sensor 23, delay 40, and one-shot 41 all cooperate to function as a status detector for both the K1 relay 18 and K2 relay 20 switches. Those skilled in the art know for this detector circuit also that there are other ways to structure a device for detecting the status of relay switches, and that shown here is simply one possible embodiment. The output of AND gate 37 is a status signal which indicates that the status of the K1 and K2 relay 18 and 20 switches is correct for this stage of the connect process.

Under normal conditions when all three of its inputs have logical 1 values during the pulse from one-shot 41, AND gate 37 provides a logical 1 status signal to the S or Set terminal of flip-flop 35. Since normally the K1 relay 18 switch will have opened before the pulse from one-shot 41 occurs, and there will still be a logical 1 demand signal present, a logical 1 value to each of the AND gate 37 input terminals will exist for the duration of the one-shot 41 pulse. The logical 1 pulse to the S input of flip-flop 35 causes flip-flop 35 to set, and its Q output to change from logical 0 to logical 1. This logical 1 from the flip-flop 35 Q output terminal forms a connect signal for K2 relay .20, and is provided to the input terminal of relay driver 25, as well as to the input terminal of delay 33. The logical 1 value of the connect signal applied to relay driver 25 causes the K2 relay 20 switch to begin closing, connecting terminal 20*a* to terminal 20*b*.

At this stage of the connect process, the K2 relay 20 switch should be closed or in the process of closing, but there should be no voltage at either terminal 20*a* or 20*b*, because K1 relay 18 is still open. A second test of the operation of switch system 11 conditions further advancing the connect process on absence of power voltage at terminals 18*b* and 20*b* after the K2 relay 20 switch has finished closing. Power voltage at either terminal 18*b* or 20*b* indicates a malfunction of some sort, such as K1 relay 18 having closed after previously been open when tested by AND gate 37.

The transition from logical 0 to logical 1 in the value of the connect signal from the Q terminal of flip-flop 35 is delayed by delay 33 and applied to the input terminal of a one-shot 36. The delay element 33 is chosen to have a delay constant somewhat longer than the time required for the K2 relay 20 switch to close; perhaps 100–200 ms. is suitable in most cases. One-shot 36 need only have a pulse time sufficient to set flip-flop 30. The output of one-shot 36 is applied to one input terminal of AND gate 31. If there is still a valid demand signal, a logical 1 signal is applied to the S terminal of flip-flop 30 during the pulse from one-shot 36.

Should voltage be detected at terminal 20*b* at this stage of the connect process, this malfunction requires the connect process to be aborted. An AND gate 34 receives the delayed connect signal for K2 relay 20 from delay element 33, and the power signal from voltage sensor 26. If the delayed K2 connect signal is present and the power signal from voltage sensor 26 is a logical 0 (indicating that voltage is present at terminal 20*b*) then both inputs of AND gate 34 are satisfied, and AND gate 34 provides a logical 1 output. This logical 1 signal is provided to an input of an OR gate 51, causing OR gate 51 to provide a logical 1 output to a one-shot 53. One-shot 53 should provide a pulse whose length is similar to that of one-shot 41. The output of one-shot 53 is provided to an R (Reset) input of flip-flop 35. The logical 1 applied to the flip-flop 35 R input causes flip-flop 35 to clear, and the Q output to change from logical 1 to logical 0. Recall that the flip-flop 35 Q output provides the second connect signal for relay driver 25. The change in state of flip-flop 35 ends the second connect signal provided to relay driver 25 and causes the K2 relay 20 switch to open. In effect this terminates the connect process for this demand interval. The logical 1 output of AND gate 34 is also provided to a terminal 70 which can externally indicate a fault condition.

In normal operation, the logical 1 signal to the flip-flop 30 S terminal from one shot 38 through AND gate 31 sets flip-flop 30 and causes its Q terminal signal to change from a logical 0 to a logical 1. The Q terminal output of flip-flop 30 is a connect signal for the K1 relay 18. This connect signal is applied to one input of OR gate 59, which provides a logical 1 signal to the input terminal of relay driver 27, causing the K1 relay 20 switch to close and current to flow from power source 15 to load 22. Delay 33, voltage sensor 26, AND gate 31 and flip-flop 30 cooperate to form a switch controller for K1 relay 18. One can see that the actual switching of current is done by the K1 relay 18 switch rather than the K2 relay 20 switch. Experience indicates that the switch which actually completes and ends a power connection suffers much more rapid deterioration than a switch which merely conducts a similar level of current. Once flip-flop 30 has set and the K1 relay 18 switch has closed, the connect process is complete.

There is a reverse sequence of events for disconnecting load 22 from terminal 15. In order to confine all of the wear to the K1 relay 18 switch, it is first necessary to open the K1 relay 18 switch before the K2 relay 20 switch is opened. To start the disconnect process, flip-flop 30 must be cleared, which occurs when the demand interval ends and an inverted demand signal is provided to the R or Reset input terminal of flip-flop 30 by inverter element 42. The logical 1 value of the inverted demand signal causes flip-flop 30 to clear and its Q and Q outputs to change from logical 1 and logical 0 respectively, to logical 0 and logical 1. The logical 0 Q output of flip-flop 30 is the end of the first connect signal and when supplied to OR gate 59, commands relay driver 27 to open the K1 relay 18 switch. There is a certain delay involved in the opening of the K1 relay 18 switch, and delay element 45 is intended to prevent opening of the K2 relay 20 switch until the K1 relay has completely opened. Relays typically open in about the same time as they close, so 150 ms. is a reasonable nominal value for the delay time for delay element 45.

After the delay time associated with delay element 45 has elapsed, OR gate 51 receives a delayed logical 1 value from the $\overline{Q}$ output of flip-flop 30. In response to that logical 1 input, OR gate 51 provides a logical 1 signal to a one-shot 53, which in response provides a short logical 1 pulse to the R or Reset input of flip-flop 35 causing flip-flop 35 to clear. The signal levels for the outputs of flip-flop 35 reverse, so that the Q and $\overline{Q}$ terminals provide logical 0 and logical 1 values respectively. The logical 0 provided by the Q output of flip-flop 35 is the end of the second connect signal and causes relay driver 25 to open the K2 relay 20 switch, returning the power connection system 10 to its normal disconnected state. This ends the normal disconnect process.

The FIG. 1 embodiment of this invention also provides a number of fault indications when faults are detected during both the connect and disconnect process. There are in this embodiment five different faults detected, and these are indicated by fault signals on terminals 66–70. There has already been mention of the fault on terminal 70 arising from voltage on terminal 20*b* before the K1 relay 18 switch has closed. In many cases a detected fault will simply cause what is called a lockout condition. Lockout results in disconnecting load 22 from terminal 15, as well as further actions such as annunciating the fault to an operator, and preventing another startup for system 10 until there is human intervention, perhaps by pressing a restart switch. The various processes by which these faults can be addressed are outside of the scope of the invention described herein.

A first fault detector provides general fault protection by monitoring the time which elapses from the start of the demand interval until the time that the K1 relay 18 switch closes for the second time to complete the connect process. This fault detector continues to monitor the voltage at terminal 18*b* to assure that voltage is present until after the demand interval ends. A normal connect process should take slightly longer than the sum of the one-shot 47 time constant, the delay times of delays 33 and 40, and the sum of the closure times of the K2 and K1 relay 20 and 18 switches. Accordingly, one process by which malfunction can be inferred is by sensing whether the time between the start of a demand interval and the end of the second closure of the K1 relay 18 switch is excessive. Assuming that each of the relays 18 and 20 will close or open in a maximum of 150 ms., then the maximum total time required for successfully completing the connect process is around 600 ms. Of course relays which close and open more slowly or quickly will require a longer or shorter connect process time.

A delay element 60 receives the demand signal from terminal 50 and provides a delayed demand signal to one input of AND gate 62. The delay time for delay element 60 should approximately equal the connect process time, say 600 ms. in the example here. Delay element 60 is necessary to account for the connect process time, and is used to suppress the fault indication until this time has elapsed. The delay time for delay element 60 should exceed the time to first close and open the K1 relay 18 switch, then close the K2 relay 20 switch, and again close the K1 relay 18 switch.

AND gate 62 serves as a fault test element, and when its output at terminal 66 is a logical 1, a fault in system 10 operation is likely. The demand signal delayed by delay element 60 is applied to one input of a first test AND gate 62. The power signal from voltage sensor 23 is applied to a second input of AND gate 62. The undelayed demand signal is applied to a third input of AND gate 62. After the delay 60 time has elapsed, voltage sensor 23 should provide a logical 0 to its input of AND gate 62. Before this tire has elapsed, a normal connect process will result in power voltage at terminal 18*b* and a logical 1 as an output from voltage sensor 23 to AND gate 62. But the delayed demand signal from delay 60 prevents a fault indication. In order to prevent a false fault indication from occurring when the demand interval ends and after the K1 relay 18 switch opens, the undelayed demand signal is also provided as an input to AND gate 62. So AND gate 62 inputs are not satisfied—the condition indicating an error—once the demand interval has ended and the demand signal level returns to a logical 0.

The test performed by AND gate 62 detects faults arising from failures to satisfy the inputs to AND gates 44, 37, and 31 in a timely fashion. It also detects faults which might arise from a relay closing more slowly than usual and certain voltage sensor failures. Thus, AND gate 62 serve as a generalized fault detector.

A second fault detector continuously monitors for closure of the K1 relay 18 switch when no connect signal is present for the K1 relay 18. A second test AND gate 64 receives at its inverting input terminal 64*a* the power signal from voltage sensor 23, meaning that this input is satisfied by the logical 0 output from voltage sensor 23 when power voltage is present at terminal 18*b*. AND gate 64 also receives at inverting input terminal 64*b*, the value of the connect signal. provided by OR gate 59 undelayed, meaning that input 64*b* is satisfied as soon as the connect signal value from OR gate 59 changes to logical 0 from logical 1. Inverting input terminal 64*c* of AND gate 64 receives the connect signal from OR gate 59 delayed by delay element 63. Delay element 63 should have a delay time greater than the time required for K1 relay 18 to open its switch, which in this example we take to be 150 ms. This prevents an erroneous fault indication during the opening time for K1 relay 18. After the connect signal has changed from logical 1 to logical 0 and the delay element 63 delay time has elapsed, then both inputs 64*b* and 64*c* are satisfied. If at this time point, the power signal from voltage sensor 22 has not yet become the logical 1 which indicates that power voltage at terminal 18*b* has vanished, then all of the inputs to AND gate 64 have been satisfied and a fault is indicated by a logical 1 at terminal 67. This fault means that the K1 relay 18 switch is improperly closed, typically a welded contact.

A third fault detector detects an improper open condition of the K1 relay 18 switch. Third test AND gate 61 receives as inputs the demand signal; the power signal from voltage sensor 23; the undelayed connect signal for the K1 relay 18; and the connect signal for the K1 relay 18 delayed by delay element 63. Delay element 63 should have its delay time to be the longer of the times required for the K1 relay 18 switch to open or to close responsive to changes in the connect signal provided by OR gate 59. The undelayed connect signal is required as an input to AND gate 61 also to prevent an erroneous fault indication from briefly existing when the K1 relay 18 switch opens responsive to the connect signal value changing from a logical 1 to a logical 0 during normal operation and before the delayed connect signal can propagate through delay element 63. The demand signal at terminal 50 must be a logical 1 when the connect signal from OR gate 59 is a logical 1 so the demand signal is also required as an input to AND gate 61. When the demand signal is a logical 1, and OR gate 59 has been providing a connect signal for a time long enough for the K1 relay 18 switch to close, then if the voltage sensor 23 is providing a logical 1 indicating that voltage is not present at terminal 18*b*, then a fault condition exists. AND gate 61 tests for failure of the K1 relay 18 switch to close or remain closed in this situation and signals this condition with a logical 1 signal at terminal 68.

A fourth test detects improper voltage at terminal 20*b*. If the K2 relay 20 is not receiving a connect signal from the Q output of flip-flop 35, then the flip-flop 35 NOT Q output should be a logical 1. In this situation, there must not be any power voltage at terminal 20*b*, and the output of voltage sensor 26 should be logical 1, denoting this situation. The output of voltage sensor 26 is applied to an inverting input of AND gate 65. If voltage sensor 26 provides a logical 0, this along with the logical 1 from the NOT Q output of flip-flop 35 satisfies the two inputs to AND gate 65, causing a logical 1 output at terminal 69 which is a fault indication.

AND gate 34 was previously mentioned as a safety element which detects the presence of voltage at terminal 20*b* before the K1 relay 18 switch has closed. Since this is a fault condition, it is annunciated at terminal 70 as a fifth fault condition. The faults detected by AND gates 65 and 34 are similar, but occur at different times in the connect process. Separate indications allow easier troubleshooting.

Software Implementation

FIGS. 2*a* and 2*b* disclose a preferred embodiment of this relay controller invention in the form of a flowchart from which a person with relatively minimal skills can easily code the firmware which implements the invention within a microcontroller 12. The microcontroller 12 when operating under the control of this firmware can emulate the form of the invention as disclosed in FIG. 1 to implement the process for properly closing, holding closed, and opening the K1 and K2 relays 18 and 20 switches. In addition, this software implementation can also monitor the switch and relay control signal status during operation. We assume that the switching system 11 is available for connection to the microcontroller 12 through its I/O ports or through some type of interface unit. Since these aspects are well known to those familiar with this technology, no further note will be taken of these issues.

The flowchart of FIGS. 2*a* and 2*b* uses well known graphic conventions for displaying the invention's embodiment, and comprises two different types of software elements. The rectangular boxes enclose statements which describe some type of data manipulation activity, so these will be called action elements. The hexagonal boxes enclose statements which describe a test of data, and provide for selecting one of two designated paths depending on the outcome of that test. These are called decision elements. These two kinds of elements are connected by connection lines having arrows which specify the sequence of actions. Round circles simply designate connection or continuity between two connection lines, with the letter within when present creating the association.

Action elements and decision elements in a very real sense have physical existence, in that when microcontroller 12 executes the firmware instructions which implement the function described in the element involved, the microcontroller physically becomes a device for a brief period of time which performs that function. The data which results from performing that function is stored in the microcontroller memory and is available when a software element needs that data at a later time.

Microcontroller 12 has a number of input ports which can sense the voltage level of a signal applied to them, and output ports on which the microcontroller 12 can control a signal voltage level. Thus the demand signal at terminal 50 and the voltage sensor 23 and 26 signals are all available for testing by the appropriate instruction sequence. Output ports can provide the control signals to the K1 and K2 relays 18, 20. We prefer that these control signals are accessible for testing, and most microcontrollers can provide this capability.

In the flowchart of FIGS. 2*a* and 2*b*, there is mention of K1 and K2 flags. These are individual bits in the microcontroller 12 memory which are used to control the status of the K1 and K2 relays 18 and 20. The K1 and K2 flags are analogous to flip-flops 30 and 35 respectively, in that setting the K1 and K2 flags causes the K1 and K2 relays 18 and 20 switches respectively to close. However, it is typical that the K1 and K2 flags will not be elements which can directly provide the control signal for the relay drivers 25 and 27. For ease of explanation however, it is assumed that setting the K1 flag causes the K1 relay 18 switch to close without further instruction execution and clearing the K1 flag causes the K1 relay 18 switch to open. The same operation is assumed for K2 relay 20.

Execution of instructions which the flowchart of FIGS. 2*a* and 2*b* define in every case starts where indicated on FIG. 2*a*. We expect that the microcontroller 12 includes some sort of scheduler or software manager which periodically transfers instruction execution to the START point of FIG. 2*a*. When instruction execution for the relay controller routine is complete for a particular call, a connection arrow terminates at the word EXIT, and execution transfers back to the scheduler. A typical time period for each call of the relay controller might be every 100 ms. after the previous execution has finished. In some cases, the first execution arises as a function of power being applied to microcontroller 12.

There a three different major function seats which the FIGS. 2*a* and 2*b* software causes microcontroller 12 to perform. These are load connection, load disconnection, and relay status testing. Status testing has two different function subsets depending on whether power terminal 15 is or is not currently connected to load 22.

Upon starting a call to the software, decision element 81 tests whether there is a demand signal at terminal 50. If so, then instruction execution is transferred to decision element 82 whose instructions cause microcontroller 12 to test whether the K1 and K2 flags within the microcontroller 12 memory is set. As mentioned, the K1 and K2 flags are used to indicate respectively that the K1 and K2 relays 18 arkd 20 are closed. The condition of both the K1 and K2 flags both being set also indicates that load 22 is electrically connected to terminal 15. As mentioned, the K1 and K2 flags are closely analogous to the flip-flops 30 and 35, which when both set and after the K1 relay 18 switch has closed, indicates that load 22 is connected to terminal 15.

If both the K1 and K2 flags are set then the current status of voltage at the K1 a nd K2 terminals 18*b* and 20*b* is tested by decision element 84 to assure proper functioning of the K1 and K2 relay switch elements. Instruction execution transfers to the instructions of decision element 84 which cause microcontroller 12 to test whether the voltage sensors 23 and 26 both are providing signals respectively indicating that voltage is present at relay terminals 18*b* and 20*b*. If the result of these tests indicates that voltage is present at both terminals 18*b* and 20*b*, then instruction execution has been completed for this call of the routine. Current status of K1 and K2 relays 18, 20 has been tested arLd found to be correct, and execution transfers back to the scheduler.

If voltage is not present at both terminals 18*b* and 20*b*, this indicates an error condition, and instruction execution transfers through connection element A 99 to error manager action elements 101 and 102. Element 101 attempts to shut down operation of the load 22 by clearing the K1 flag which normally will open the K1 relay 18 switch. Element 101 also delays further operation for 150 ms. Then element 102 continues the shutdown process by locking out the system, clearing the K2 flag to thereby open the K2 relay 20 switch, and indicating the fault condition in some way. This process provides maximum opportunity to open both the K1 and K2 relay 18 and 20 switches. The software may lock out the system simply by setting a lockout bit.

Should element 82 determine that one or both of the K1 and K2 flags were not set, then instruction execution transfers decision element 87, which tests whether the K1 flag status is different from the K2 flag. At this stage of the relay manager routine, the status of the K1 and K2 flags should be the same, either both set or both cleared. If the status if the K1 and K2 flags is different, instruction execution transfers to connection element A 99 and the instructions of action elements 101 and 102.

If element 87 determines that the K1 flag status is the same as the K2 flag status, then the instructions of decision element 109 are performed. This element corresponds to the functions of one-shot 43 and AND gate 46 in FIG. 1. This test assures that power voltage is not present at terminal 18*b* of K1 relay 18. Element 109 tests whether voltage is detected by voltage sensor 23 and if it does detect power voltage, transfers instruction execution to connection element A 99 which is the fault exit.

If processing can continue to element 104, this means that both the K1 and K2 flags have their cleared status. It has already been determined that the demand signal is present. The meaning of all of these conditions is that the load connection function may be performed. This situation arises whenever the demand signal appears and the connection system is operating normally. The start of the demand signal is inferred from the presence of the demand signal (decision element 81 test) and the cleared state of the K1 and K2 flags (decision elements 82 and 87). Element 87 then transfers instruction execution to the instructions symbolized by the action element 104.

Action element 104 starts a sequence of instructions which tests whether the K2 relay 20 switch is closed at the start of the demand signal. If so this is a fault condition which requires lockout action. Action element 104 sets the K1 flag, which causes the K1 relay 13 switch to start closing. Then, the instructions symbolized by action element 107 are executed, which causes microcontroller 12 to wait the 150 ms. required for K1 relay 18 to close. The functions of the action element 104 and 107 instructions are roughly equivalent to one-shot 47, which applies a 150 ms. pulse causing the K1 relay 18 switch to close for a period of time when the demand signal first appears.

After the 150 ms. pulse has ended, decision element 110 tests that voltage sensor 23 detects voltage at terminal 18*b*. If there is no voltage at terminal 18*b*, this is a lockout condition indicating that the K1 relay 18 switch did not close, and instruction execution transfers to action element 101 via connector A 99. If the K1 relay 18 switch closed properly, then instruction execution moves to the instructions symbolized by decision element 112, which tests whether there is voltage at terminal 20*b*. If voltage sensor 26 detects power voltage at terminal 20*b* this means that the K2 relay 20 switch is closed, which is a fault condition. This fault condition also transfers instruction execution to the connector A 99 and lockout processing. The tests which decision elements 110 and 112 perform are analogous to the test which AND gate 44 performs in testing for proper states of the power signals from voltage sensors 23 and 26 at this stage of the connection process.

If there is no power voltage at terminal 20*b*, then the instructions for action element 115 clear the K1 flag and again wait 150 ms. for the K1 relay 18 to completely open its switch. This delay is analogous to the one-shot 40 delay. Instruction execution continues with the sequence following connector C 124 on FIG. 2*b*. If at this stage in the connection process, the demand interval has ended, then the decision element 121 instructions cause normal exit from the instruction execution sequence. The repeated testing for presence of the demand signal which element 121 provides is optional.

The decision element 125 represents instructions which cause microcontroller 12 to test the power signal from voltage sensor 23. If this power signal is a logical 0, this means that power voltage is likely to be present at terminal 18*b*, which is a fault condition. The implication is that K1 relay 18 failed to open after this last closure and opening sequence. This fault condition is annunciated by following connector A 99 to execute the instructions of action element 101 as previously explained. The instructions comprising decision elements 121 and 125 simulate the condition testing that AND gate 37 of FIG. 1 provides.

Assuming that there is no voltage at terminal 18*b* at this stage of the connection process, the instructions of action element 127 are executed next, which cause microcontroller 12 to set the K2 flag. By setting the K2 flag, microcontroller 12 provides a connect signal to relay driver 25 in the same way that flip-flop 35 provides a connect signal. Then the instructions of action element 130 cause microcontroller 12 to wait 150 ms. for the K2 relay 20 switch to completely close. This wait or delay of action element 130 corresponds to delay 33 of FIG. 1. After this delay, then microcontroller 12 executes the instructions of decision element 133 which again test for the values encoded in the signals from voltage sensors 23 and 26. If either power signal is a logical 0, this indicates presence of power voltage at the respective terminal 18*b* or 20*b*, which is a fault condition at this stage of the connection process. As before, instruction execution transfers to action element 101 and the connection process is aborted. Decision element 133 is the firmware equivalent of AND gate 31 of FIG. 1. For AND gate 31 to have its inputs satisfied, both terminals 18*b* and 20*b* must have no power voltage and the demand signal must have its logical 1 value present.

Assuming that the test of decision element 133 is passed successfully, microcontroller 12 next follows connection element D 138 to execute the instructions corresponding to action element 135. Element 135 sets the K1 flag once more, which provides a connect signal to the K1 relay driver 27 and the K1 relay 18 switch starts to close. Delay element 137 suspends further instruction execution for 150 ms. while the K1 relay 18 switch closes. This completes the closure or connection process, and load 22 should now be receiving power from terminal 15.

We prefer a further redundant check of connection status, so instruction execution transfers to decision element 84 (FIG. 2*a*) through connector B 83, whose operation has been explained above. Assuming normal results from the element 84 test, instruction execution returns to the scheduler.

At some time, the demand signal value will change from logical 1 to logical 0 indicating the end of the demand interval. This will be detected by the instructions of decision element 81 and cause microcontroller 12 to execute instructions which implement the functions of decision element 85. These instructions cause microcontroller 12 to test whether the K1 and K2 flags have equal values. If the K1 and K2 flags have unequal values, this is a fault condition, and execution transfers to element 101 through. connection element 99. If the K1 and K2 flag values are equal, then the instructions of decision element 87 are executed. Decision element 87 tests the value of the K1 flag and if set, then instruction execution continues to action elements 88 and 91 which clear the K1 flag and cause microcontroller to delay further processing for 150 ms. while the K1 relay 18 contracts open. Then, or if decision element 87 detected that the K1 flag was not set, execution continues with the instructions of decision element 94. The element 94 test confirms that both relays 18 and 20 have opened and voltage is no longer present at either terminal 18*b* or 20*b*. If voltage is detected at either terminal 18*b* or 20*b*, execution transfers to connection element A 99. If the normal condition of no terminal 18*b* or 20*b* voltage is detected execution continues with action element 97 which clears the K2 flag after which control returns to the scheduler. It is possible to omit the test provided by decision element 87 if the wait time of element 91 is not needed for other processing needs. This concludes the disconnect process.

There are many other ways to implement this invention in a software format. It is also possible to omit certain of these tests without deviating from the essential aims of this invention, which is to perform all of the normal current switching with the upstream K1 relay 18, and reserve the downstream K2 relay 20 for use during the emergency situation where the K1 relay 18 fails to open normally.

The preceding allows a person of skill in the art to practice the invention which is described in the following claims:

1. In a power connection system for supplying power to a load during a demand interval defined by a predetermined value of a demand signal, said connection system having i) a first electrically controlled switch having first and second power terminals, and a first control terminal for receiving a first connect signal, and responsive thereto establishing electrical contact between the first switch's first and second power terminals, and ii) a second electrically controlled switch having first and second power terminals, and a second control terminal for receiving a second connect signal, and responsive thereto establishing electrical contact between the second switch's first and second power terminals, said first switch's first power terminal for connection to a power source, said first switch's second power terminal and said second switch's first power terminal in electrical connection, and said second switch's second power terminal for connection to the load, a switch operating system comprising:

a) a first voltage sensor having a sensor terminal connected to the first switch's second power terminal, and providing at a signal terminal a first power signal having a first value responsive to power voltage present at the sensor terminal and having a second value otherwise;

b) a switch status detector receiving the first power signal and the demand signal, and responsive to the start of the demand interval and the second value of the first power signal, providing a first status signal having a second value, and a first value otherwise; and c) a switch controller receiving the first status signal and responsive to the second value thereof, providing the second connect signal to the second control terminal and after a first preselected interval, providing the first connect signal to the first control terminal.

2. The power connection system of claim 1, wherein the switch controller includes a first delay element receiving the second connect signal and responsive thereto providing the first connect signal to the first control terminal after the first preselected interval.

3. The power connection system of claim 2, wherein the switch status detector comprises a first AND gate receiving the demand signal and the first power signal and providing the first status signal, and wherein the switch controller comprises a second memory element receiving the first status signal from the AND gate and recording a connect value responsive to the first status signal's second value, and providing the second connect signal as a function of said recorded connect value.

4. The power connection system of claim 3, and further comprising a second voltage sensor having a sensor terminal connected to the second switch's second power terminal, and providing at a signal terminal a second power signal having a first value responsive to power voltage at the sensor terminal thereof and having a second value otherwise, and wherein the switch controller comprises a second AND gate receiving the second power signal and the second connect signal, and responsive to the first value of the second power signal and the second connect signal, aborting the provision of the first connect signal to the first control terminal.

5. The power connection system of claim 4, wherein the second AND gate receives the second connect signal from the first delay element.

6. The power connection system of claim 4, wherein the switch controller includes a first memory element receiving the output of the second AND gate second connect signal from the second memory element and recording a connect value responsive to the second connect signal from said second memory element, and cooperating with the first delay element to provide the first connect signal to the first control terminal after the first preselected interval.

7. The power connection system of claim 6, wherein the switch controller further comprises in the first memory element, a reset terminal receiving the demand signal and responsive to the end of the demand signal interval, the first memory element records a disconnect value and responsive to the disconnect value ends the first connect signal provided to the first switch.

8. The power connection system of claim 7, wherein the switch controller further comprises i) in the second memory element, a reset terminal for receiving a disconnect signal and responsive thereto, recording a disconnect value and responsive to the disconnect value, ending the second connect signal, and ii) a second delay element receiving the first connect signal, and responsive to its end and after a second preselected interval, providing the disconnect signal to the second memory element's reset terminal.

9. The power connection system of claim 2, wherein the switch controller includes a first disconnect element ending the first connect signal responsive to the end of the demand interval, a second delay element receiving the first connect signal and providing a delayed first connect signal, and a second disconnect element ending the second connect signal responsive to the end of the delayed first connect signal.

10. The power connection system of claim 9, wherein the switch controller includes a third AND gate receiving the delayed first connect signal and the first power signal, and responsive to the second value of the first power signal and the end of the delayed first connect signal, providing a first error signal.

11. The power connection system of claim 2, wherein the switch controller includes a third delay element receiving the demand signal, a logic element connected to receive the demand signal from the third delay element and the first power signal, and responsive to the first value of the first power signal and the end of the demand interval provided by the third delay element, providing a second error signal.

12. The power connection system of claim 2, wherein the switch status detector comprises i) a first one-shot receiving the demand signal, and responsive to the start of the demand interval providing a first connect signal to the first control terminal for a predetermined interval;

ii) a second voltage sensor having a sensor terminal connected to the second switch's second power terminal, and providing at a signal terminal a second power signal having a first value responsive to power voltage at the sensor terminal thereof and having a second value otherwise; and iii) a first test element receiving the first power signal and the second power signal, and responsive to the second value of the first power signal, and the first value of the second power signal, providing to the switch controller the first status signal having a second value, and a first value otherwise.

13. The power connection system of claim 2, wherein the switch status detector comprises a second voltage sensor having a sensor terminal connected to the second switch's second power terminal, and providing at a signal terminal a second power signal having a first value responsive to power voltage at the sensor terminal thereof and having a second value otherwise;

and wherein the switch controller comprises a second test element receiving the first power signal, the second power signal, and the second connect signal, and responsive to the second connect signal and the second value of the first and second power signals, providing the first connect signal to the first control terminal.

14. The power connection system of claim 13, wherein the second test element receives the output of the first delay element as the second connect signal.

15. The power connection system of claim 2, wherein each switch has a predetermined closure time, said power connection system further including a fault detector comprising i) a fourth delay element receiving the demand signal and providing a delayed demand signal, said fourth delay element having a delay interval exceeding the sum of the first and second switches' delay times; and ii) a first fault test element receiving the output of the fourth delay element and the first power signal, and responsive to coincidence of the start of the demand interval delayed by the fourth delay element and the second value of the first power signal, providing a fault indication.

16. The power connection system of claim 15, wherein the switch controller provides the first connect signal to the first control terminal for a preselected test period, said test period longer than the predetermined Closure time for the first switch, and wherein the fourth delay element has a delay interval longer than the test period plus the sum of the closure times for the first and second switches.

17. A method for ensuring fail-safe control of electric current supplied to a load from a source through first and second switches connected in series between the source and the load, the first and second switches each having first and second power terminals of which the first power terminal of the first switch is connected to the source, the second power terminal of the first switch and the first power terminal of the second switch are connected together, and the second power terminal of the second switch is connected to the load, the first and second switches each normally responsive to closing and opening commands to respectively (i) establish electrical continuity between its first and second power terminals and (ii) break electrical continuity between its first and second power terminals, the method, upon desired energization of the load, comprising the steps of:

performing a first check of voltages at the second power terminals of the first and second switches;

if voltages no greater than a reference voltage are found during the first check, providing a first closing command to the first switch;

performing a second check of voltages at the second power terminals of the first and second switches;

if a voltage greater than the reference voltage is found at the second power terminal of the first switch and a voltage no greater than the reference voltage is found at the second power terminal of the second switch during the second check, providing a first opening command to the first switch;

performing a third check of voltages at the second power terminals of the first and second switches;

if voltages no greater than the reference voltage are found during the third check, providing a first closing command to the second switch; and after providing the first closing command to the second switch, providing a second closing command to the first switch.

18. The method of claim 17 comprising the additional steps of:

after providing the first closing command to the second switch, performing a fourth check of voltages at the second power terminals of the first and second switches; and providing the second closing command to the first switch only if voltages no greater than the reference voltage are found at the second power terminals of the first and second switches during the fourth check.

19. The method of claim 17, upon desired deenergization of the load, comprising the steps of;

providing a second opening command to the first switch; and after providing the second openig command to the first switch, providing a first opening command to the second switch.

20. The method of claim 18 comprising the additional steps of:

after providing the second closing command to the first switch, performing a fifth check of voltages at the second power terminals of the first and second switches; and if voltages greater than the reference voltage are not found at the second power terminals of the first and second switches during the fifth check, establishing an alarm condition which, without operator intervention, precludes provision of subsequent closing commands to the first and second switches.

21. The method of claim 19 comprising the additional steps of:

after providing the second opening command to the first switch, performing a sixth check of voltages at the second power terminals of the first and second switches; and if voltages greater than the reference voltage are found at the second power terminal of at least one of the first and second switches, establishing an alarm condition which, without operator intervention, precludes the provision of subsequent closing commands to the first and second switches.

* * * * *